US005332103A

United States Patent [19]

Zittel

[11] Patent Number: 5,332,103

[45] Date of Patent: Jul. 26, 1994

[54] BEAN GRADER

[75] Inventor: David R. Zittel, Columbus, Wis.

[73] Assignee: Lyco Manufacturing, Inc., Columbus, Wis.

[21] Appl. No.: 999,392

[22] Filed: Dec. 31, 1992

[51] Int. Cl.[5] ..... B07B 13/075

[52] U.S. Cl. ..... 209/664; 209/683; 209/290; 209/394

[58] Field of Search ..... 209/284, 288, 289, 290, 209/394, 395, 396, 404, 405, 407, 664, 683, 690

[56] References Cited

U.S. PATENT DOCUMENTS

| | | | |
|---|---|---|---|
| 770,079 | 9/1904 | Lamb . | |
| 1,703,591 | 2/9129 | Olney . | |
| 2,895,610 | 7/1959 | Copping et al. | 209/284 X |
| 2,984,351 | 1/1961 | Van Slyck et al. | 209/98 |
| 3,055,500 | 9/1962 | Aubert-Maguero | 209/288 |
| 3,241,667 | 3/1966 | Grosbety | 209/98 |
| 3,831,752 | 8/1974 | Holloway | 209/394 |
| 4,049,124 | 9/1977 | Coppolani et al. | 209/98 |
| 4,078,995 | 3/1978 | Utt | 209/284 X |
| 5,165,548 | 11/1992 | Dumler et al. | 209/288 X |

OTHER PUBLICATIONS

"Cyco Model 1700 Single and Double Bar-Type Bean Graders," Chisholm-Ryder Co., Inc. Niagara Falls, N.Y.

"Instructions For Weld-Splicing," Eagle Belting Co., Des Plaines, Ill.

"Eagle Urethane Belting Tool Price List," Eagle Belting Company, Des Plaines, Ill.

"Price List Eagle Urethane Belting," Eagle Belting Co., Des Plaines, Ill.

*Primary Examiner*—H. Grant Skaggs
*Assistant Examiner*—Carol Lynn Druzbick
*Attorney, Agent, or Firm*—Lathrop & Clark

[57] ABSTRACT

A grader drum has fixed grader bars which extend between two annular end plates. Rotatable grader bars extend between the end plates between each pair of fixed bars. A generally frustoconical cam is movable axially with respect to the drum. A cam follower with a roller which engages against the cam is connected to each rotatable grader bar. A looped elastic belt encircles the cam followers and engages with radially outwardly facing grooves on the cam follower arms to retain the cam followers in engagement with the cam as the cam is displaced axially to adjust the spacing between the fixed and rotatable grader bars.

7 Claims, 4 Drawing Sheets

BEAN GRADER

FIELD OF THE INVENTION

The present invention relates to apparatus for processing agricultural products in general and to apparatus for sorting vegetables by size in particular.

BACKGROUND OF THE INVENTION

In the food processing industry it is often desirable to separate agricultural products into a number of grades based on the size of the product. Grading is often necessary to comply with regulatory or customer demands for general uniformity in product size. Furthermore, a premium price may be obtainable for agricultural products of a desired size. Smaller beans, for example, command a higher price than larger ones by weight.

One known grading apparatus utilizes an inclined rotatable drum having a cylindrical wall comprised of alternating fixed and rotatable bars. Each rotatable bar has a width which is greater than its height such that spacing between each rotatable bar and The two adjacent fixed bars may be adjusted by rotation of the bar. To obtain uniform grading it is important that the spacing between all rotatable bars and the fixed bars be constant at a desired setting. In this known apparatus spacing is controlled by a frustoconical cam which bears against cam following rollers which are attached to each rotatable grader bar at the grader inlet. This cam has a recessed portion at the top of the drum travel which causes the grader bars to open to their wider spacing to release food product which has become trapped between grader bars. In order to retain the grader bar cam followers engaged against the cam each individual cam follower is provided with a coil spring which extends between the cam follower arm and the drum end plate.

As a typical grader may employ 30–50 rotatable grader bars and rollers, a great number of coil springs are required. Furthermore, the constant flexing to which the springs are subjected will result in eventual spring failure. The failure of one spring may not be immediately obvious to the grader operator yet will result in the improper grading of the processed food product.

What is needed is a grader for agricultural products having cam followers which are consistently engaged against the cam, which employs a minimum of parts, and which provides immediate visual indication of failure.

SUMMARY OF THE INVENTION

The grader for beans and like agricultural products of this invention has a rigid frame with a drum rotatably mounted on the frame. The drum has two end plates which are connected by fixed grader bars. A plurality of rotatable grader bars are mounted between the end plates and an arm is mounted to each rotatable grader bar and extends radially outwardly from the axis of grader bar rotation. A cam following roller is mounted to each arm such that the axis of roller rotation is offset from the axis of grader bar rotation. An adjustable cam is mounted to the frame and is displacable towards and away from the arms. The cam has a frustoconical portion such that axial displacement of the cam causes the rotation of the rotatable grader bars and adjustment of the spacing It is an object of the present invention to provide a bean grader employing a minimal number of parts.

It is a further object of the present invention to provide a grader with consistent spacing between grader bars.

It is also an object of the present invention to provide a grader which yields immediate visual indication of cam engagement failure.

It is yet another object of the present invention to provide a grader with means for retaining cam followers against the cam which is easily and rapidly replaceable.

Other features, objects and advantages of the present invention will become apparent from the following description when taken in consideration with the accompanying drawings.

DESCRIPTION OF THE PREFERRED EMBODIMENT

Figure 1:
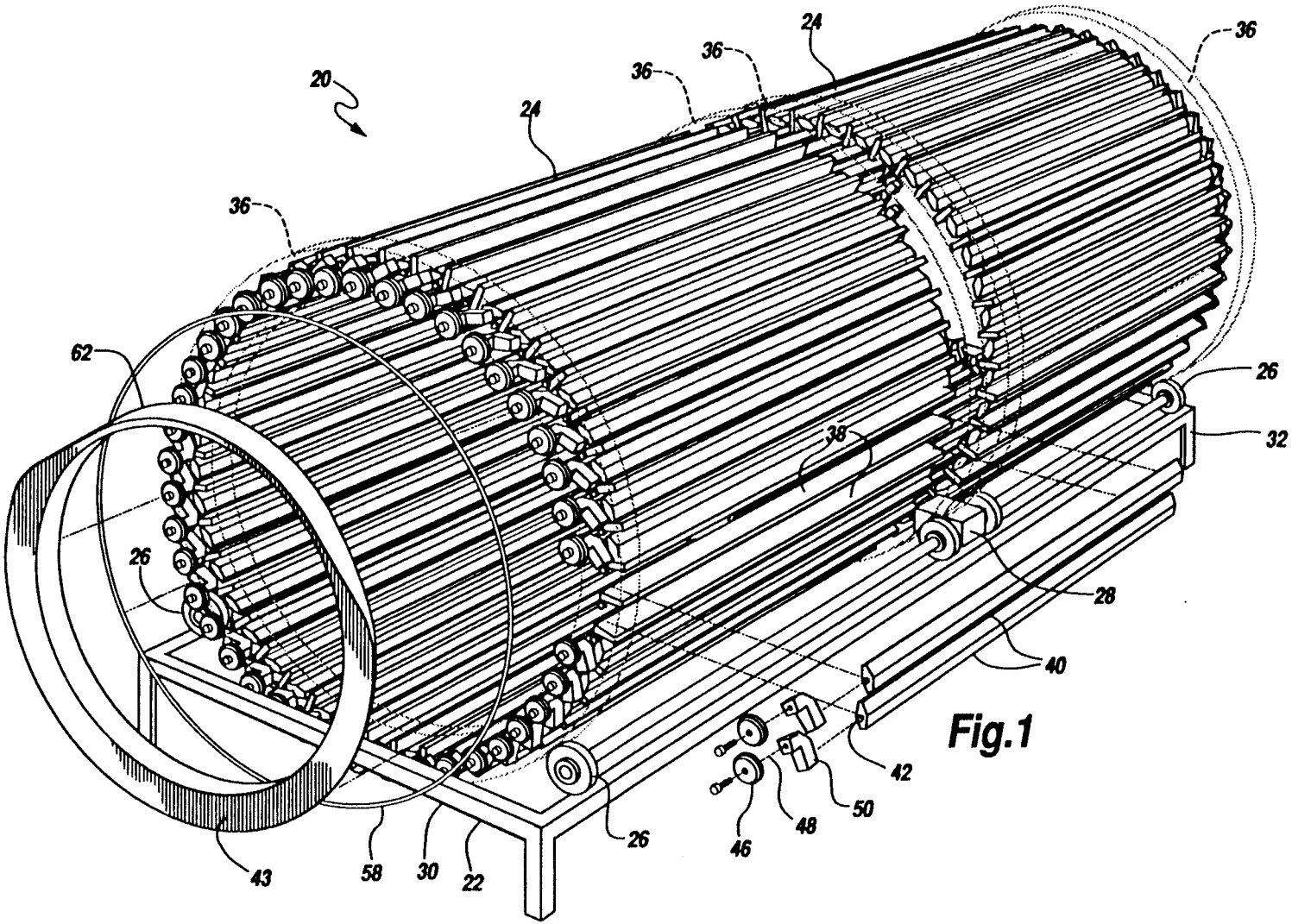
FIG. 1 is an exploded isometric view of the beam grader of the present invention with end plates shown in phantom lines for greater visibility.
Figure 2:
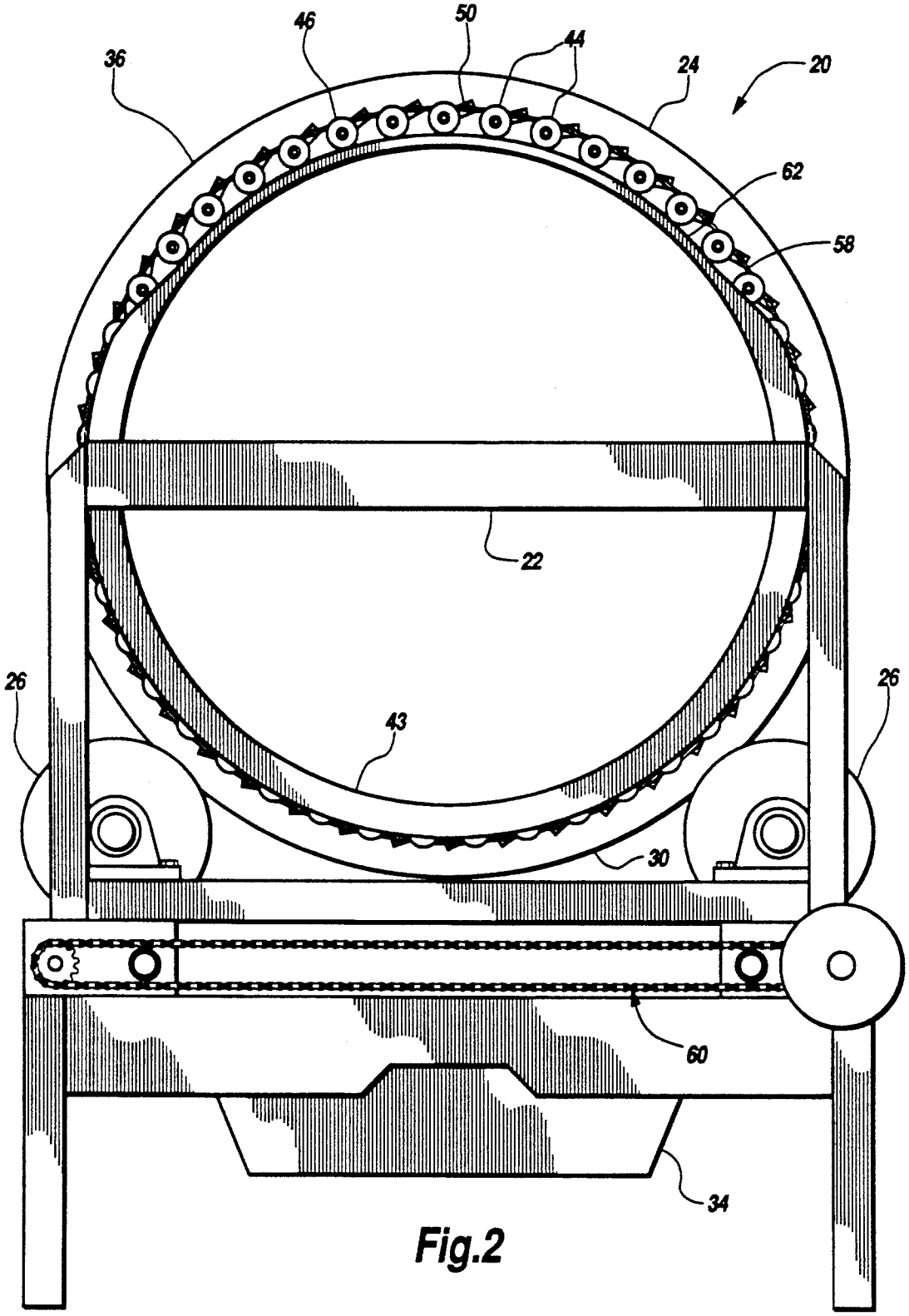
FIG. 2 is a front elevational view of the bean grader of FIG. 1.

Referring more particularly to FIGS. 1–8, wherein like numbers refer to similar parts, the bean grader 20 of the present invention is shown in FIG. 2. Although the grader 20 will be described in its application for grading beans such as snap beans, it should be understood that the grader may be employed to grade other elongated vegetables.

The grader 20 has a rigid support frame 22 preferably formed of stainless steel square tubing. Two identical drums 24 are mounted to the frame on four flanged rollers 26. The rollers are turned by drive motors 28 to rotate each drum about its longitudinal axis. The drums may be driven together or driven at differing speeds. The drums 24 are inclined such that the inlet end 30 of the grader 20 is above the outlet end 32. As shown in FIG. 2, bean receiving chutes 34 are positioned beneath each drum to receive beans which are graded by passing through the drum side walls. The grader 20 is thus capable of separating an inflow of beans into three grades by size, two grades being received in the chutes 34 and the third grade being discharged at the outlet end 32 of the grader 20.

Each drum 24 has two annular end plates 36. The end plates 36 are preferably formed of an easily cleaned plastic material. The end plates are connected together by a plurality of generally wedge-shaped fixed grader bars 38. The number of fixed grader bars will depend on the size of the drum 24. The exemplary grader 20, shown in FIG. 1, which has a drum outer diameter of approximately 48 inches and a length of approximately 52 inches, utilizes forty-five fixed grader bars 38.

Figure 4:
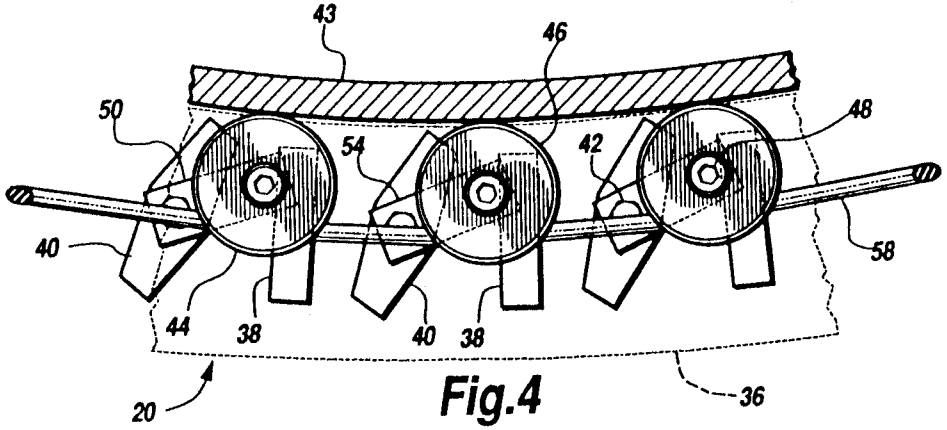
FIG. 4 is a fragmentary front elevational view of the beam grader of FIG. 3 taken along line 4—4.
Figure 5:
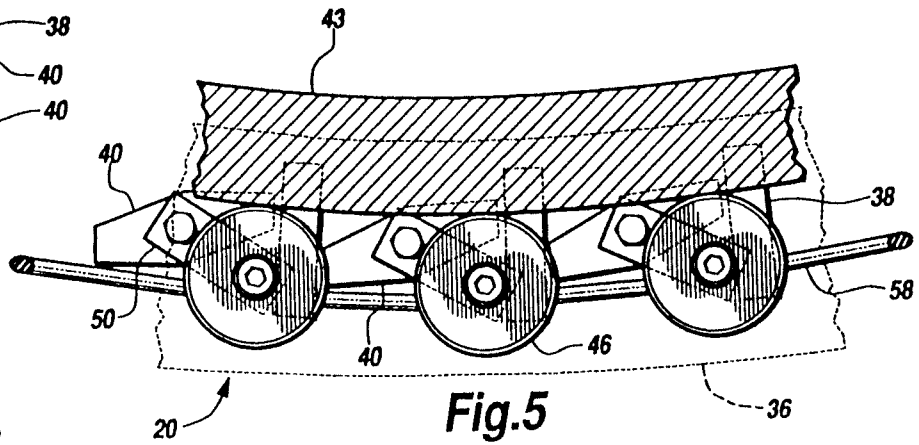
FIG. 5 is a fragmentary front elevational view of the bean grader of FIG. 4 adjusted for a narrow grading space.
Figure 6:
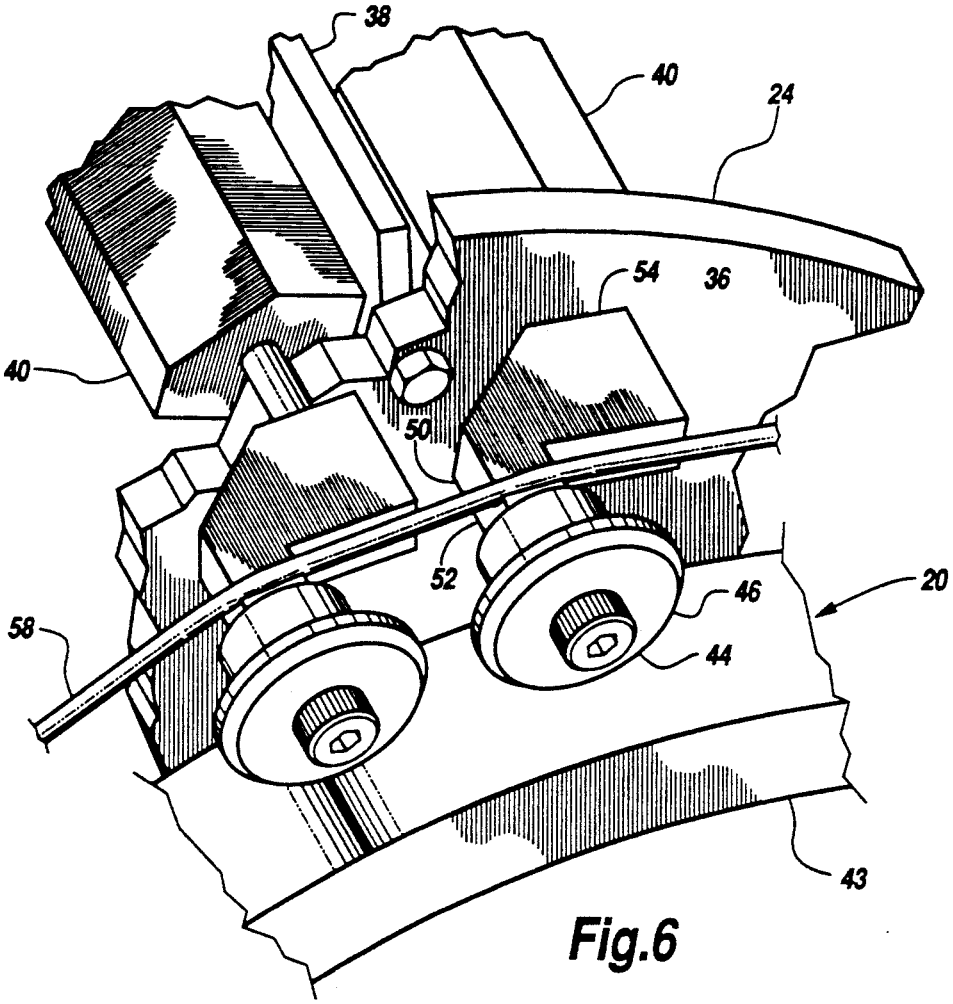
FIG. 6 is a fragmentary isometric view, partially broken away, of the bean grader of FIG. 2.

A rotatable grader bar 40, best shown in FIG. 6, is mounted between each pair of fixed grader bars 38. As best shown in FIGS. 4 and 5, each rotatable grader bar 40 has a narrow dimension and a wide dimension which extends generally radially. The exemplary rotatable grader bars 40 shown are six sided parallelpipeds. Each grader bar 40 is rotatable about an axis of rotation 42 to adjust the spacing between the rotatable grader bar 40 and the adjacent fixed grader bars 38. By thus rotating the rotatable grader bars 40, the grader 20 may be adjusted to allow only beans of a desired size to escape from the drum 24 through the grader bars 38, 40.

Figure 7:
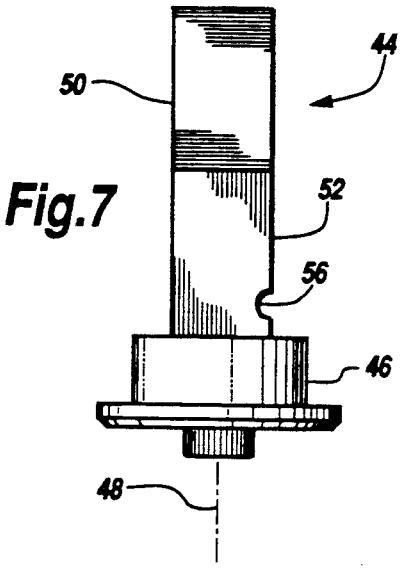
FIG. 7 is a top plan view of a cam follower arm and attached roller of the bean grader of FIG. 2.
Figure 8:
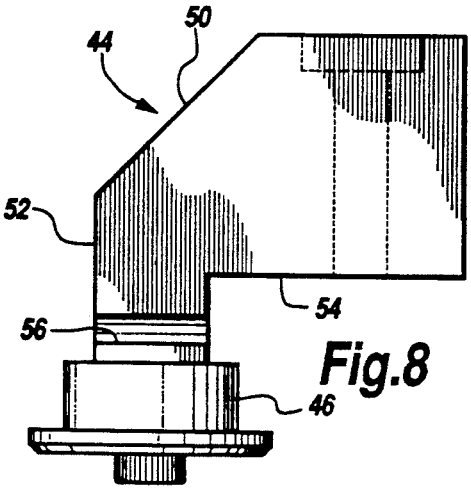
FIG. 8 is a side elevational view of the cam follower arm and roller of FIG. 7.

To insure uniformity of grading, it is essential that the rotatable grader bars 40 are consistently adjusted to provide even spacing between the rotatable and fixed grader bars. To provide this consistent spacing a generally frustoconical cam 43 is mounted to the frame 22 for axial motion towards and away from the exterior end plates 36 of each drum 24. Each rotatable grader bar 40 has a cam follower 44 attached thereto. As best shown in FIGS. 7 and 8, each cam follower 44 has a roller 46 rotatably mounted about a roller axis 48 to a generally L-shaped cam follower arm 50. The cam follower arm 50 has an axial leg 52 which extends away from the end plate 36 and a radial leg 54 which runs along the end plate 36. The roller 46 is mounted to the axial leg 52 and the radial leg 54 is rotatably mounted to the end plate 36 and is fixed to a rotatable grader bar 40 so the rotatable grader bar axis of rotation 42 intersects the radial leg 54. Each cam follower arm 50 preferably has portions defining a groove 56 on the radially outwardly facing portion of the axial leg 52.

Figure 3:
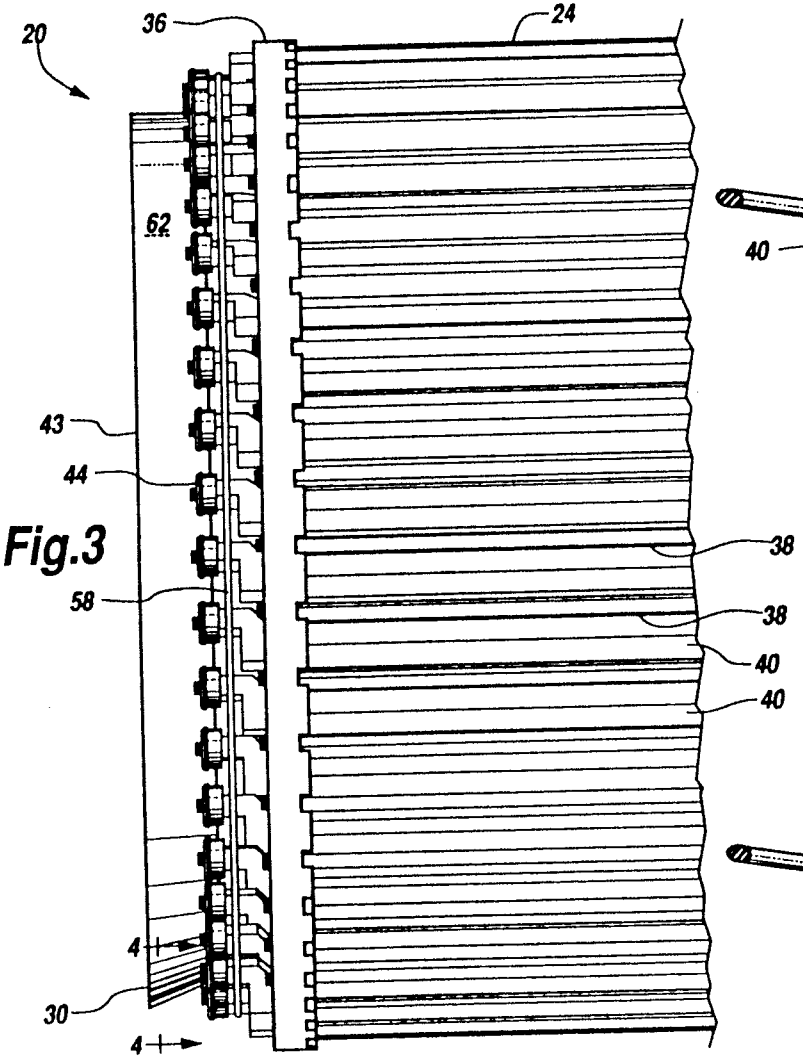
FIG. 3 is a fragmentary side elevational view of the bean grader of FIG. 2.

As best shown in FIGS. 2 and 3, the rollers 46 of the cam followers 44 are retained in engagement with the cam 43 by a resilient looped belt 58 which encircles and engages against the arms 50 of all the cam followers 44. The belt is preferably ⅝" urethane round belting, such as that manufactured by Eagle Belting Company of Des Plaines, Ill. The belt 58 is retained within the grooves 56 of the cam follower arms 50 and retains the rollers 46 in engagement with the cam 43 for any desired cam position. As best shown in FIGS. 4 and 5, the position of a cam roller 46 determines the spacing of the attached rotatable grader bar 40 from the fixed grader bars 38. As the roller axis 48 is offset from the rotatable grader bar axis 42, the radial leg 54 of the cam follower 44 acts as a lever arm causing the rotatable grader bar 40 to rotate as the roller 46 is displaced radially outwardly. A conventional chain drive assembly 60, shown only in FIG. 2 for clarity, is connected to each cam 43 to allow the cams to be moved longitudinally inwardly and outwardly to set the grader bar spacing at any desired grade of bean size. At the narrowest portion of the cam 43 as shown in FIG. 4, grader bar spacing is maximized, and at the larger diameter portion of the cam 43 as shown in FIG. 5, grader bar spacing is minimized. To facilitate release of beans which might become wedged between the grader bars 38, 40, the cam 44 has a cylindrical sector 62 with constant outer diameter in the upper portion of the cam. The cylindrical sector 62 causes the grader bars 40 to open to their widest spacing as the drum rotates allowing trapped beans to fall to the lower portions of the drums 24 for further sorting.

The grooves 56 are semicylindrical and engage with the cylindrical belt 58. As shown in FIG. 6, the grooves retain the axial positioning of the belt 58. The semicylindrical surface of each groove also provides surface contact between the belt and the arm 50 for more effective application of the belt tension to the cam followers.

As shown in FIG. 3, the belt 58 provides a single, mechanically simple, resilient unit for retaining the cam followers 44 in proper engagement with the cam 43. The belt 58 may be quickly and simply installed on the grader 20. An operator need only cut a length of belting to the length specified for a particular grader, splice the ends together using a conventional weld splice kit such as Model No. UT-236 available from Eagle Belting Company of Des Plaines, Ill., allow a short time period for the welded belt to cool and then place the belt around the forty-five cam followers 44.

Furthermore, as the belt 58 is a unitary part, failure of the belt 58 is immediately visually apparent. Should the belt break, it will fall from the end plate 36 making the failure obvious to the most cursory visual inspection.

It should be noted that although two drums 24 have been shown, a single drum grader may also be constructed.

It should be noted that the invention is not limited to the particular construction and arrangement of parts herein illustrated and described, but embraces such modified forms thereof as come within the scope of the following claims.

I claim:

1. A vegetable grader comprising:

a) a rigid frame;

b) a drum rotatably mounted to the frame, wherein the drum has first and second end plates with fixed grader bars which extend between the end plates;

c) a plurality of rotatable grader bars mounted between the end plates, wherein each grader bar is rotatable about an axis;

d) an arm mounted to each rotatable grader bar and extending radially from the axis of grader bar rotation;

e) a cam following roller rotatably mounted to each arm about an axis, wherein the axis of roller rotation is offset from the axis of grader bar rotation;

f) an adjustable cam mounted to the frame for displacement towards and away from the first end plate, the cam having a frustoconical portion engaged with the cam following rollers such that the displacement of the cam causes radial displacement of the cam following rollers which in turn causes the rotation of the rotatable grader bars; and g) an elastic looped belt which encircles all the arms and retains the cam following rollers engaged against the cam.

2. The vegetable grader of claim 1 wherein the elastic belt is formed of urethane belting.

3. The vegetable grader of claim 1 wherein the elastic belt is generally circular in cross section.

4. The vegetable grader of claim 1 wherein each arm has a first portion which extends radially from the rotatable bar and a second portion which extends from the first portion away from the drum end plate, and wherein the second portion has portions defining a groove therein, and the elastic belt engages with the groove.

5. A vegetable grader comprising:

a) a frame;

b) a drum rotatably mounted to the frame, wherein the drum has two end plates and a plurality of longitudinally extending fixed grader bars;

c) a plurality of rotatable grader bars, wherein a rotatable grader bar is rotatably mounted between the end plates and intermediate between two fixed grader bars;

d) a cam follower mounted to each rotatable grader bar, the cam follower having a roller mounted to an arm which is connected to a rotatable grader bar, and wherein radial displacement of the arm causes rotation of the rotatable grader bar to adjust the spacing between the rotatable grader bar and the fixed grader bars between which it is mounted;

e) an adjustable cam mounted to the frame for displacement towards and away from an end plate; and f) an elastic looped belt which encircles all the cam followers and which retains the cam followers against the cam, wherein the cam is adjustable to displace portions of the cam followers radially outwardly to bring about rotation of the rotatable grader bars.

6. The vegetable grader of claim 5 wherein each cam follower has portions defining a radially outwardly facing groove, and wherein the belt engages with the cam follower grooves.

7. A vegetable grader comprising:

a) a frame;

b) a drum rotatably mounted to the frame, wherein the drum defines a passage for travel of vegetables therethrough;

c) a plurality of rotatable grader bars mounted to the drum, wherein rotation of the rotatable grader bars adjusts for vegetable size which may escape from the grader through the drum past the grader bars;

d) a cam follower mounted to each rotatable grader bar, wherein each cam follower has portions defining a radially outwardly facing groove;

e) a cam which has a surface which engages against the cam followers, wherein the position of the cam determines the position of the rotatable grader bars and sets the size of vegetable which may escape past the bars; and f) an elastic looped belt which encircles the cam followers and which engages with the cam follower grooves to retain the cam followers in engagement with the cam.

* * * * *